US005492156A

United States Patent [19]

Dyer et al.

[11] Patent Number: 5,492,156

[45] Date of Patent: Feb. 20, 1996

[54] HAND HELD TIE TENSIONING AND CUT-OFF TOOL

[75] Inventors: Edward P. Dyer, Germantown; William K. Lueschen, Cedarburg, both of Wis.

[73] Assignee: Tyton Corporation, Milwaukee, Wis.

[21] Appl. No.: 209,635

[22] Filed: Mar. 10, 1994

[51] Int. Cl.[6] ..... B21F 09/02

[52] U.S. Cl. ..... 140/123.6; 140/93.2

[58] Field of Search ..... 140/93.4, 93.2, 140/123.6; 411/108; 30/125

[56] References Cited

U.S. PATENT DOCUMENTS

| | | | |
|---|---|---|---|
| 3,130,765 | 4/1964 | Neuschotz | 411/108 |
| 3,845,554 | 11/1974 | Joanis et al. | 30/125 |
| 3,853,155 | 12/1974 | Kabel | 140/123.6 |
| 4,793,385 | 12/1988 | Dyer et al. | 140/123.6 |
| 4,997,011 | 3/1991 | Dyer et al. | 140/93.2 |

*Primary Examiner*—Lowell A. Larson

*Attorney, Agent, or Firm*—Michael, Best & Friedrich

[57] ABSTRACT

Disclosed herein is a tool for tensioning and severing an elongate cable tie having a tie head portion and tie tail portion, the tool comprising a housing, structure for gripping and tensioning the tail of the cable tie, the structure including pawl links, and a tie guide plate integral with one of the pawl links and having a tie tail engaging surface, the structure being capable of reciprocating linear movement relative to the housing, and the structure including a rotatable pawl adapted to selectively engage the cable tie tail and apply pressure to the cable tie tail so that it is pressed against the tie tail engaging surface of the guide plate during linear movement of the gripping and tensioning structure, a pawl cover mounted on the pawl links, having opposite edges mounted in slots in the housing for sliding reciprocal movement with the pawl links, the pawl cover in the slots restraining the pawl links and the tie guide plate against twisting and impeding entry of the tie tail into the housing, and structure for severing the cable tie tail from the cable tie head upon attainment of a preselected tension in the cable tie.

16 Claims, 10 Drawing Sheets

HAND HELD TIE TENSIONING AND CUT-OFF TOOL

BACKGROUND OF THE INVENTION

The present invention relates generally to hand held tensioning and cutting tools, and particularly to hand held tools for applying high tension to flexible cable ties and cutting the tie tails thereof.

Flexible cable ties are widely used in a variety of applications to bundle multiple wires or cables. Such cable ties typically include an elongated tail portion which is threaded through an integral head portion to encircle the wires, and the tie tail is drawn through the cable tie head to tightly bind the cables into a bundle. After the tie is tensioned around the cable bundle, the excess length of the tie tail extending out of the head portion is then severed close to the head by the tool.

Attention is directed to U.S. Pat. Nos. 4,997,011 and 4,793,383, which are assigned to the assignee hereof, and which are incorporated herein by reference.

SUMMARY OF THE INVENTION

The invention provides a tool for tensioning and severing an elongate cable tie having a tie head portion and tie tail portion. The tool comprises a housing having opposed slots, means, supported by the housing, for gripping and tensioning the tail of the cable tie, the gripping and tensioning means including pawl links, and a tie guide plate integral with one of the pawl links. The tie guide plate is located outside of the housing, and has a tie tail engaging surface. The gripping and tensioning means is capable of reciprocating linear movement relative to the housing, and includes a rotatable pawl adapted to selectively engage the cable tie tail and apply pressure to the cable tie tail so that it is pressed against the tie tail engaging surface of the guide plate during linear movement of the gripping and tensioning means. The tool further includes a pawl cover mounted on the pawl links. The pawl cover has opposite edges mounted in the slots in the housing for sliding reciprocal movement with the pawl links. The pawl cover restrains the pawl links and the tie guide plate against twisting about an axis parallel to the direction of linear reciprocal movement, and the pawl cover further impedes entry of the tie tail into the housing. The tool further includes means for severing the cable tie tail from the cable tie head upon attainment of a preselected tension in the cable tie.

In one aspect of the invention, the tool further includes means for positioning the tie tail away from the pawl cover, the positioning means comprising the tie tail engaging surface of the guide plate being angled relative to the pawl cover such that when the rotatable pawl applies pressure to the cable tie tail so that it is pressed against the tie guide plate, a portion of the tie tail adjacent the pawl cover is angled away from the pawl cover.

In another aspect of the invention, the pawl cover comprises a synthetic thermoplastic or thermosetting material, and the housing comprises synthetic thermoplastic or thermosetting material, so that there is plastic to plastic contact between the pawl cover and the slots in the housing.

In another aspect of the invention, the housing is in the general shape of a gun, and includes a handle portion, and a barrel portion forward of the handle portion. The barrel portion has a top and a bottom, and the severing means includes a blade selectively movable in the barrel portion along the direction defined between the bottom and top of the barrel portion. The tool further comprises a nosepiece mounted to the barrel portion, the nosepiece including a top portion spaced from the top of the barrel portion. The blade severs the cable tie tail against the top portion of the nosepiece. The nosepiece further includes a forward surface integral with and transverse to the nosepiece top portion, the forward surface being generally parallel to the blade. The nosepiece further includes a bottom lip portion integral with and transverse to the forward surface, the bottom lip portion extending along the bottom of the barrel portion, in contact with the bottom of the barrel portion.

In another aspect to the invention, the barrel further includes opposite sides, the nosepiece further includes a side portion integral with and transverse to the forward surface, transverse to the nosepiece bottom lip portion, transverse to the nosepiece top portion, and extending along one of the barrel sides. The other of the barrel sides includes a recess having therein an aperture and a shoulder surrounding the aperture. The tool further comprises a screw fastening the nosepiece to the barrel, the screw extending through the nosepiece side portion and into the aperture in the recess. The tool further comprises a nut in the recess, engaging the shoulder, and threaded to the screw.

In another aspect of the invention, the tool further includes actuating means. The actuating means includes an actuator, cam means, and a cam follower operatively connecting the cam means to both the actuator and the severing means. The cam means has a pair of spaced apart cam arms, the cam arms having parallel spaced apart first and second cam surfaces. The first cam surfaces are arcuate and provide for pivotal movement of the cam follower thereon, and the second cam surfaces are generally planar, adjacent the first cam surfaces, and provide for linear movement of the cam follower thereon. The cam follower is restrained to pivotal movement on the first cam surfaces by restraining means until the preselected tension is attained in the cable tie whereupon the actuator moves the cam follower from the first cam surfaces to the second cam surfaces and into operative engagement with the severing means to actuate the severing means. The tool further comprises means on the cam follower and cooperating with the cam arms for restricting movement of the cam follower in the direction defined between the cam arms. In one aspect of the invention, the means for restricting movement of the cam follower comprises a projection on the cam follower, which projection is captured between the cam arms.

In another aspect of the invention, the housing has opposite sides, and a spare blade compartment is defined in the housing. The spare blade compartment includes a slot selectively housing a spare blade, an opening on one of the sides of the handle permitting insertion and removal of the spare blade from the handle, and an opening on the other side of the handle which will not permit pass the spare blade but which can be accessed by a tool to push the spare blade out of the handle. The spare blade compartment further includes resilient means extending into the slot for releasably retaining the spare blade in the slot by friction.

These and other features, objects and advantages of the present invention will be clearly understood upon review of the following detailed description, claims, and drawings.

DESCRIPTION OF THE PREFERRED EMBODIMENTS

Figure 2:
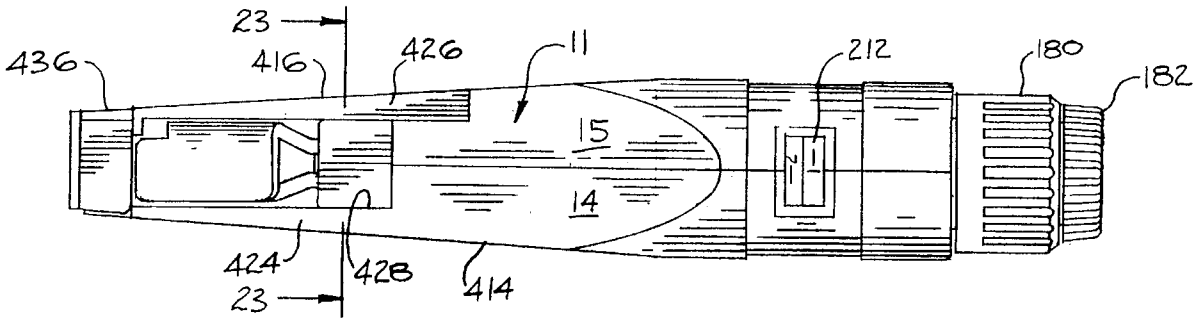
FIG. 2 is a top plan view of the tool of FIG. 1A.
Figure 1A:
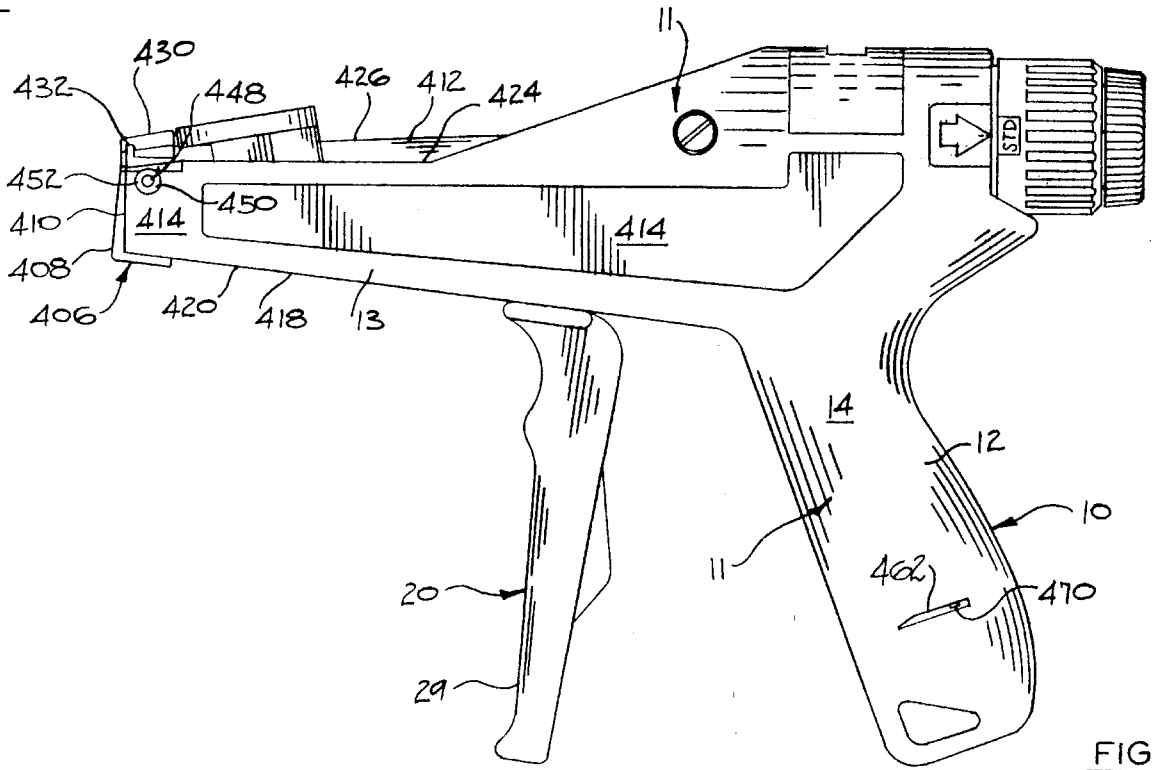
FIG. 1A is a left side elevational view of a hand-held tool embodying various features of the invention.
Figure 1B:
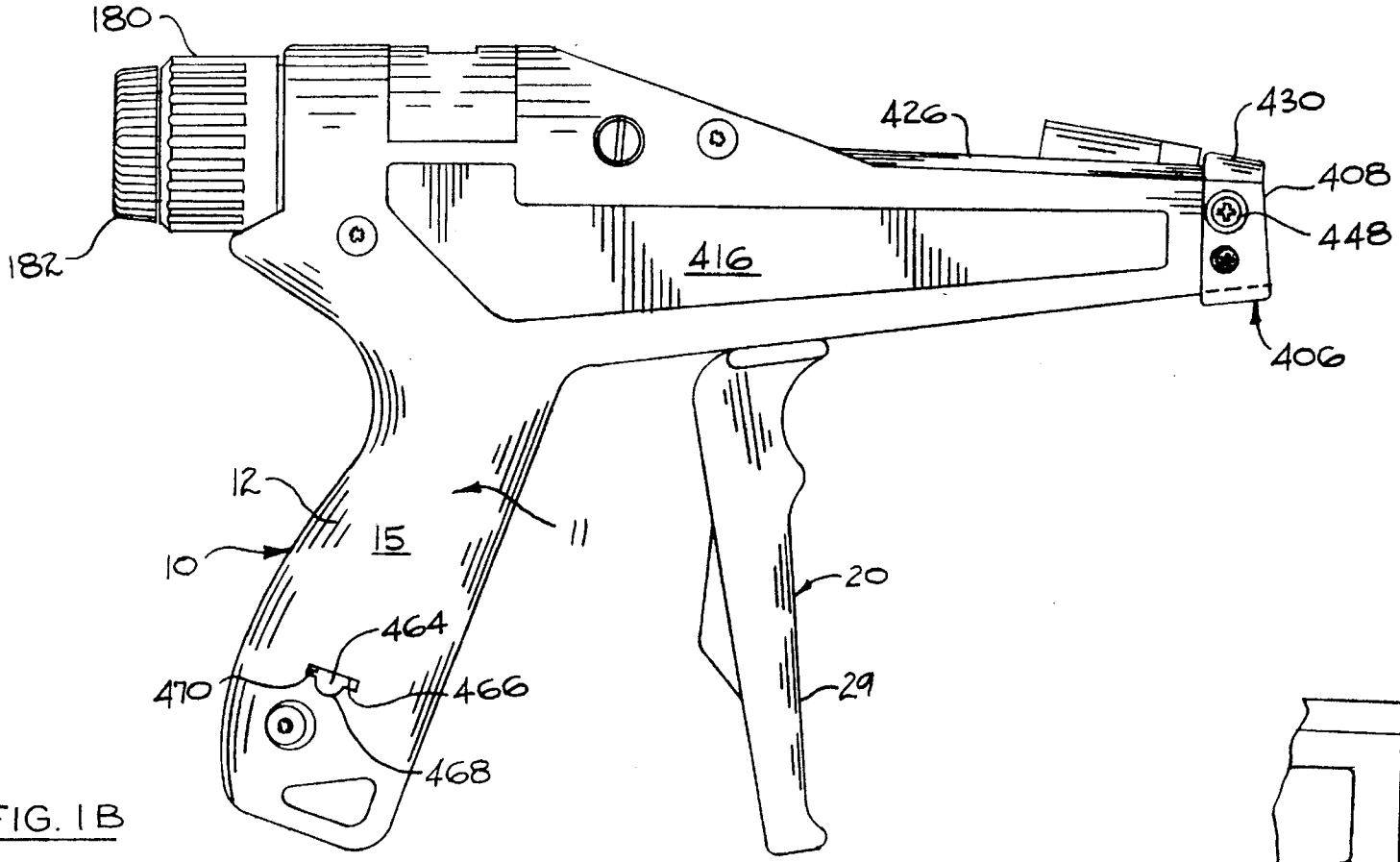
FIG. 1B is a right side elevational view of the tool of FIG. 1A.
Figure 22:
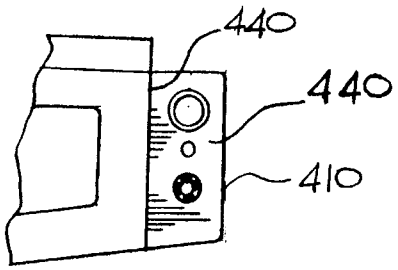
FIG. 22 is a fragmentary right side view showing the tool of FIG. 1A with the nosepiece removed.

Referring now the drawings, and in particular FIGS. 1–6, a preferred embodiment of a tie tool 10 incorporating the principles of the present invention is shown as having a housing 11 in the shape of a pistol or gun having a handle portion 12 and barrel portion 13. The housing 11 includes two separate sidewall portions 14 and 15 that are secured together to define the handle portion 12 and the barrel portion 13. The barrel portion 13 has a front 410, a top 412, opposite sides 414 and 416, and a bottom 418. In the illustrated embodiment, the side 414 includes a planar surface, the side 416 includes a planar surface that is closer to the side 414 at the front 410 than proximate the handle 12, and the bottom 418 includes coplanar surfaces 420 and 422 that are respectively integral with the sides 414 and 416. The surface 420 is substantially perpendicular to the surface 414 and to the surface 416. The top 412 includes a surface 424, integral with the side 414, which surface 424 faces upwardly away from the bottom 418, which surface 424 is not parallel to the bottom 418, and which surface 424 is closer to the bottom 418 proximate the front 410 of the barrel than at a location closer to the handle 12. The top 412 also includes a raised surface 426 farther away from the bottom 418 than the surface 424, which surface 426 is integral with the side 416, which surface 426 is not parallel to the bottom 418, and which surface is closer to the bottom 418 proximate the front 410 of the barrel than at a location closer to the handle 12.

In FIGS. 3–6 one sidewall 14 of housing 11 has been cut away to show the other housing sidewall 15 and the internal parts and mechanism. The housing 11 generally contains a reciprocating tensioning member 16, formed by joining a pair of elongate pawl links 26 together with a pawl 34 for gripping the tie tail 18 of a cable tie 19 at the front end of the tensioning member 16. The pawl links 26 extend along the length of the barrel 13. In the illustrated embodiment, the pawl links 26 are joined together to form a unitary component. The tensioning member 16 is operatively connected by means of a mechanical linkage 23 to a manually operated trigger 20 (FIG. 5) which houses an actuating assembly 21. Actuating assembly 21 is also operatively connected to a selective adjustment tensioning mechanism 25 near the rear portion of the tool barrel 13 and to a tie severing mechanism 28 in the front of the tool barrel.

The tool 11 includes a nosepiece 406 is fixed to the front of the tool barrel 13. In the preferred embodiment, the nosepiece 406 is made of metal. More particularly, the nosepiece 406 is manufactured by an investment casting process for strength at lower cost. The nosepiece 406 includes a forward planar surface 408 facing away from the tool barrel 13. The nosepiece 406 includes a nose slot 32 through the forward planar surface 408, through which the tool operator passes a tie tail 18 of a cable tie 19 with the serrations of the tie 19 facing up or down, after the tail 18 has been first passed around a bundle of wires 22 and threaded through the cable tie head 24.

Figure 6:
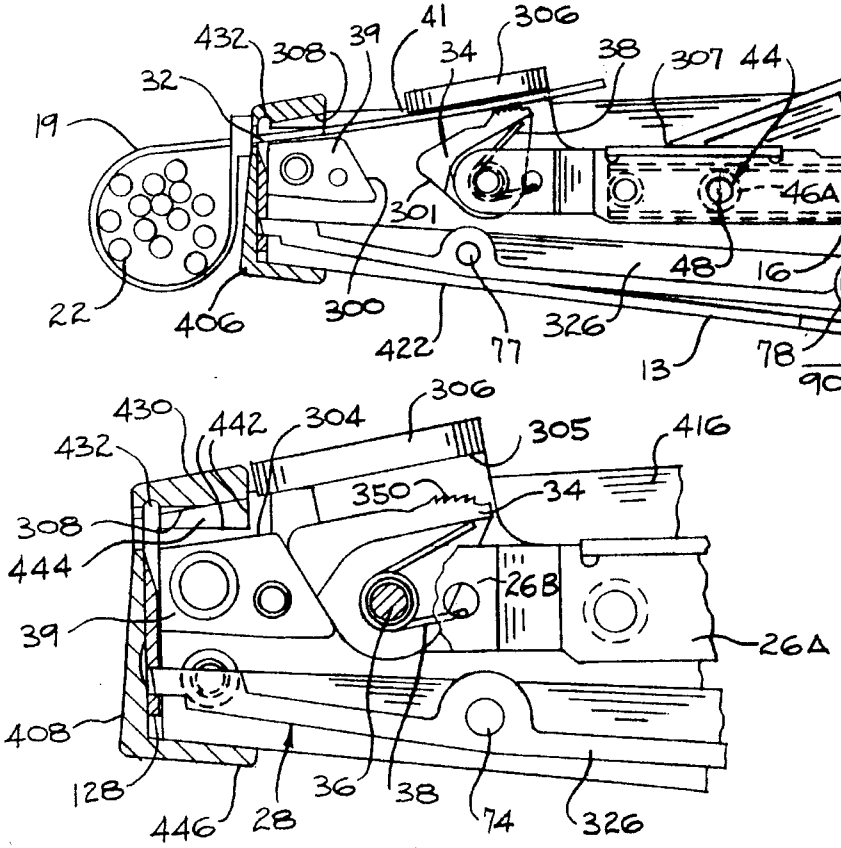
FIG. 6 is an enlarged sectional view of the nose section and tie gripping mechanism of the tool shown in FIG. 1A with a portion of the near pawl link removed.

The tool 10 includes a tensioning and gripping mechanism which in turn includes the tensioning member 16, the mechanical linkage 23, and the pawl 34. The tie tail 18 is engaged by the tie-gripping pawl 34. The pawl 34 has a plurality of tie tail gripping teeth 350 (FIG. 6). The pawl 34 is rotatably held on a shaft 36 extending between the forward open ends of the two pawl links 26. The pawl 34 extends out of the housing 11 through a rectangular aperture 428 (FIG. 2) at the top 412 of the barrel 13, which aperture 428 extends between the surfaces 424 and 426. The pawl teeth 350 are spaced apart and angled upwardly from the pawl 350. The pawl teeth 350 further have a depth and sharpness sufficient to enable the pawl 34 to grip the cable tie tail 18 on either a flat or serrated side for tensioning purposes. The pawl 34 is biased for forward rotation (counterclockwise in FIGS. 1, and 3–5) about shaft 36 by a torsion spring 38 which engages the pawl shaft and the pawl 34. The pawl 34 applies a gripping pressure on the tie tail 18 held in a tie passageway 41 between a tie guide plate 306 and the pawl 34. The tool 10 includes a mechanical linkage 23 connecting the trigger 20 to the pawl links 26. The mechanical linkage 23 includes a high-tension link 310. By squeezing the tool trigger 20 the operator applies a rearward force to the pawl links 26, thereby drawing the tie tail back toward the rear of tool 10 and tensioning the tie 19 around the wires 22.

The tool of the illustrated embodiment is capable of tensioning cable ties having from 18 pounds strength to 250 pounds strength; where the rating of ties in pound strength means that the ties can withstand the stated amount of pounds tension without breaking.

When the tool is in its initial position (FIG. 3) the tensioning member 16 (and pawl links 26) are biased into their forwardmost extent within the tool barrel 13 by a return spring 58 located in the handle 12. In this position the pawl 34 abuts a nose guide block 39 portion of the barrel 13. The rear face of the nose guide block 39 is provided with a surface 300 which engages the front face 301 of the pawl 34 when the tool trigger is released after having been squeezed. The pawl front face 301 is configured complimentary to that of the surface 300 so that the surface 300 and the pawl front face 301 interact after the tie tail has been severed and the pawl links 26 are returned to the front of the tool by the operator releasing pressure on the trigger 20. When the pawl links 26 are returned, the pawl front face 301 engages and rides on the depression 300 to rotate rearwardly (clockwise in FIGS. 3–5) to open the tie passageway 41 between the pawl 34 and tie guide plate 306, thereby allowing the severed tie tail to easily fall out of the pawl tie passageway 41.

As best shown in FIG. 6, the nose guide block 39 includes an angled surface 304 which is preferably angled slightly upwardly and positioned in the path of the nose slot 32. One of the pawl links 26 has a tie guide plate 306 formed integrally therewith. The tie guide plate 306 is angled upwardly, preferably at the same angle as the nose guide block tie ramp 304. The tie guide plate 306 includes a surface 305 extending over the pawl 34. The nosepiece 406 further includes a top portion 430 extending transversely rearwardly from the forward surface 408, above the slot 32. The top portion 430 is integral with the forward surface 408. The top portion 430 of the nosepiece 406 is provided with a surface 308, which may also be angled, (FIG. 4) which is located above the nose block guide ramp 304 and which has the same angle as the nose block guide ramp 304. The surface 308 is spaced from the nose block guide ramp 304 so that a passageway in communication with the passageway 41 is defined between the nose block guide ramp 304 and the surface 308. These multiple angled surfaces cooperate to orient the tie tail into a discard position in that they combine to urge the tie tail 18 upwardly when the tie tail 18 is inserted into the nose slot 32 of the tool.

The forwardmost portion of the right side 416 of the barrel includes a step 440, and the nosepiece 406 further includes a side portion 436 extending transversely rearwardly from the forward surface 408, which side portion 436 is seated in the step 440. The side portion 436, seated in the step 440, is generally flush with the right side 416 of the barrel rearward of the step 440. The side portion 436 is integral with the top portion 430 and the forward surface 408.

The housing sidewalls 14 & 15 have opposed slots 400 & 402 formed therein. The slots 400 and 402 each extend in directions parallel to the direction of travel of the pawl links 26. The tool includes a pawl cover 404 mounted on the pawl links 26 for movement therewith, and having opposite edges guided by the slots 400 & 402 for sliding movement. The pawl cover 404 closes the aperture 428 rearward of the pawl 34. The pawl cover 404 is made by flat stamping. The pawl cover 404 is made of a synthetic thermoplastic or thermosetting material. In the preferred embodiment, the pawl cover 404 consists of grey nylatron. This material slides easily in the slots 400 & 402 in the housing sidewalls 14 & 15, which housing sidewalls 14 & 15 are manufactured of synthetic thermoplastic or thermosetting material. In the preferred embodiment, the housing 11, the housing sidewalls 14 & 15, the handle 12, and the barrel 13, consist of Zytel 82G-332 (33% glass filled nylon). Zytel is a trademark of Dupont. This plastic on plastic contact of the pawl cover 404 with the housing sidewalls 14 provides smooth, wear resistant travel. Prior pawl covers were made of metal. The pawl cover 404 is flat, and is easily installed during manufacturing of the tool. The pawl cover 404 is thicker than prior pawl covers, for increased strength and stability. The pawl cover 404 is between 0.020 and 0.060 inches thick. In a preferred embodiment, the pawl cover 404 is between 0.035 and 0.055 inches thick. In a most preferred embodiment, the pawl cover is 0.040 inches thick±±0.002 inches. This is in comparison to prior pawl covers that were 0.008 inches thick±0.001 inches. The pawl links 26 are restricted to substantially reciprocatable linear movement within the tool housing 10 by the pawl cover 404, guided in the slots 400 & 402. The pawl cover 404, guided in the slots 400 & 402, provides stability and impedes twisting of the pawl links 36, about an axis parallel to the direction of movement of the pawl links 36, when a tie tail 18 is severed.

The tie tail 18 is maintained in its upward angle at the beginning of the tensioning stroke, through the tension stroke and subsequent severing of the tie tail 18 by the multiple angled surfaces. The tie guide plate 306 is angled relative to the pawl cover 404 so as to direct the tie tail 18 away from the pawl cover 404. The angle of the tie guide plate 306 relative to the pawl cover 404 is between 2° and 12°. Preferably, the angle of the tie guide plate 306 relative to the pawl cover 404 is between 4° and 9°. Most preferably, the tie guide plate 306 is at an angle of 7° relative to the pawl cover 404. During the tensioning stroke, the tie gripping pawl 34 engages the tie tail 18 and pushes the tie tail 18 against the tie guide plate 306, which results in the portion of the tie tail 18 rearward of the tie gripping pawl 34 being angled upward away from the pawl cover 404. By maintaining the tie tail 18 at the upward angle, the likelihood that the tie tail will find its way into the small clearance 307 between the tool tie tail engagement face 309 and the pawl cover 404 and jam the tool is greatly decreased. The pawl cover 404 has a smooth flat top surface which, deflects any tie tail 18 that might somehow be bent into contact with the pawl cover 404, such that the tie tail 18 contacts with the barrel engagement face 352, rather than the clearance 307.

The pawl links 26 are further restricted to substantially reciprocatable linear movement within the tool housing 10 by guide means 44 (FIG. 4), shown as circular roller bearings 46A, B mounted on pin shafts extending outwardly from and transverse to the pawl links 26. These bearings 46A, B ride within guide tracks 50 which extend for a preselected distance on the interior surface of the housing sidewalls 14 & 15 and guide the tensioning member in its movement within the tool barrel 13.

The pawl tensioning links 26 are operatively connected to a tool actuating assembly 21 by the mechanical linkage 23. The mechanical linkage 23 includes two actuating links 72A & 72B. The two pawl links 26 are joined to the two actuating links 72A & 72B by way of a high tension link 310. One end of the high tension link 310 is connected to the two pawl links 26 by a pin 48. Two roller bearings 46 engage the pin 48 on opposite sides thereof and ride within two tool guide tracks 50. The high tension link 310 is connected at its other end to the two actuating links 72A & 72B by means of a pivot pin 75. The actuating links 72A & 72B are held between two portions of the trigger 20.

Figures 5, 7:
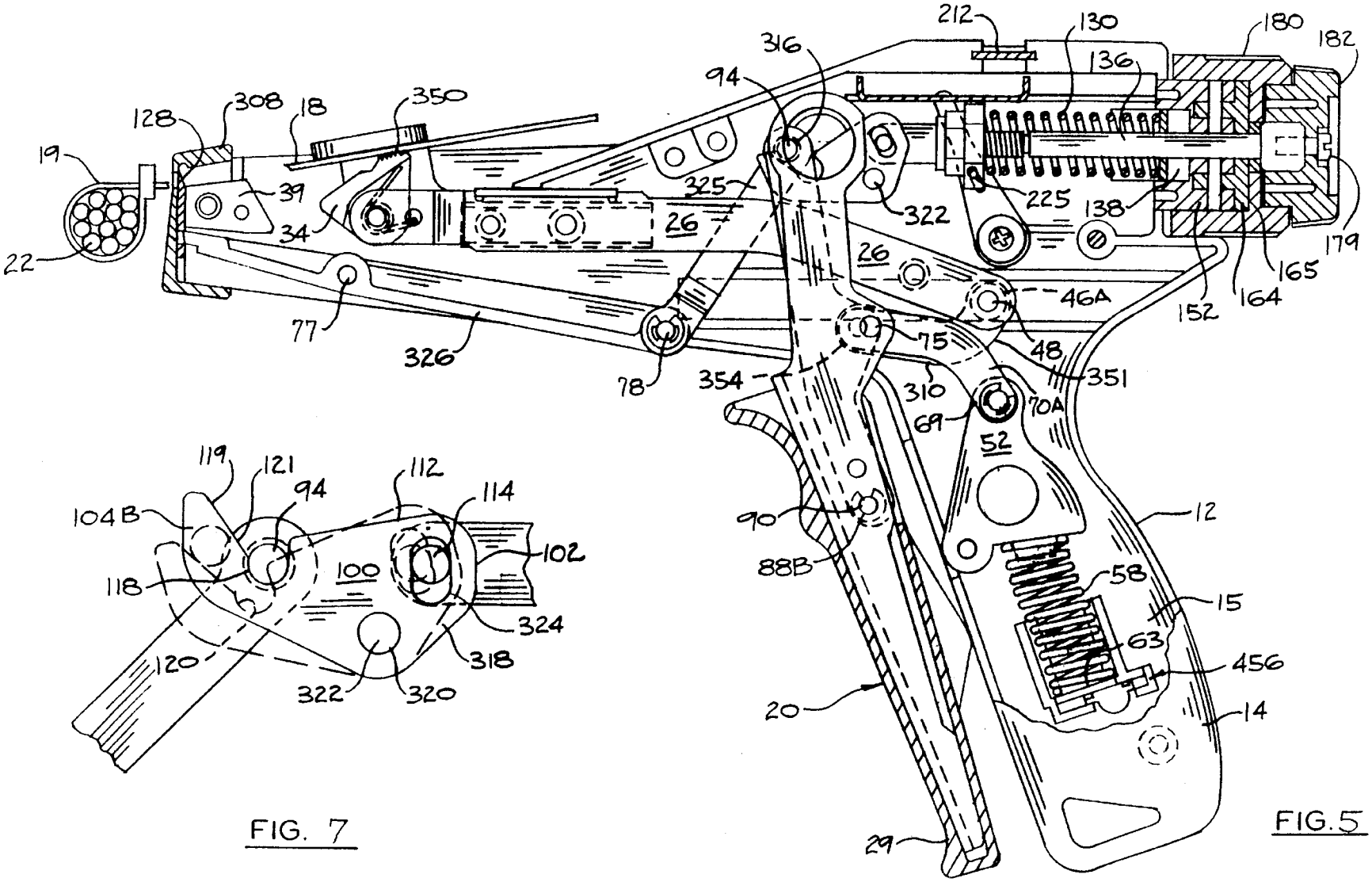
FIG. 5 is a cutaway view of the tool similar to FIG. 4, showing the tool immediately after the cable tie tail has been severed near the tie head.
FIG. 7 is a side elevational view of a cam mechanism used in the tool shown in FIG. 1A.

A handle link 52 is pivotally mounted within the tool handle 12 by a pivot pin 54 seated in a housing boss 56 in the tool sidewalls. A return spring 58 is provided which engages the lower end 59 of the handle link 52 and provides a force sufficient enough to return the trigger 20, the pawl links 26, and the pawl 34 back to the front of the tool barrel 13 after the tie tail 18 has been severed. When so returned, the arcuate leading edge of the pawl 34 will engage the nose guide block depression 300 and right itself into a tie clearance position, thereby releasing any pressure on the severed tie tail. The tie tail thereupon falls out the tie passageway 41. The return spring 58 and is held under compression in a slot 62 between the handle link 52 and the slot base 63 (FIG. 5). The slot 62 is formed by walls 64 which protrude inwardly from the tool housing sidewalls 14 & 15. Return spring 58 also provides a constant force, approximately equivalent to the return spring constant to partially resist the operator applied trigger force during tensioning. This resistance force is transmitted to the handle link 52 and translated therethrough to the two short links 70A and 70B, and then to the actuating links 72A and 72B held within the trigger 20 at pivot pin 75.

Figure 3:
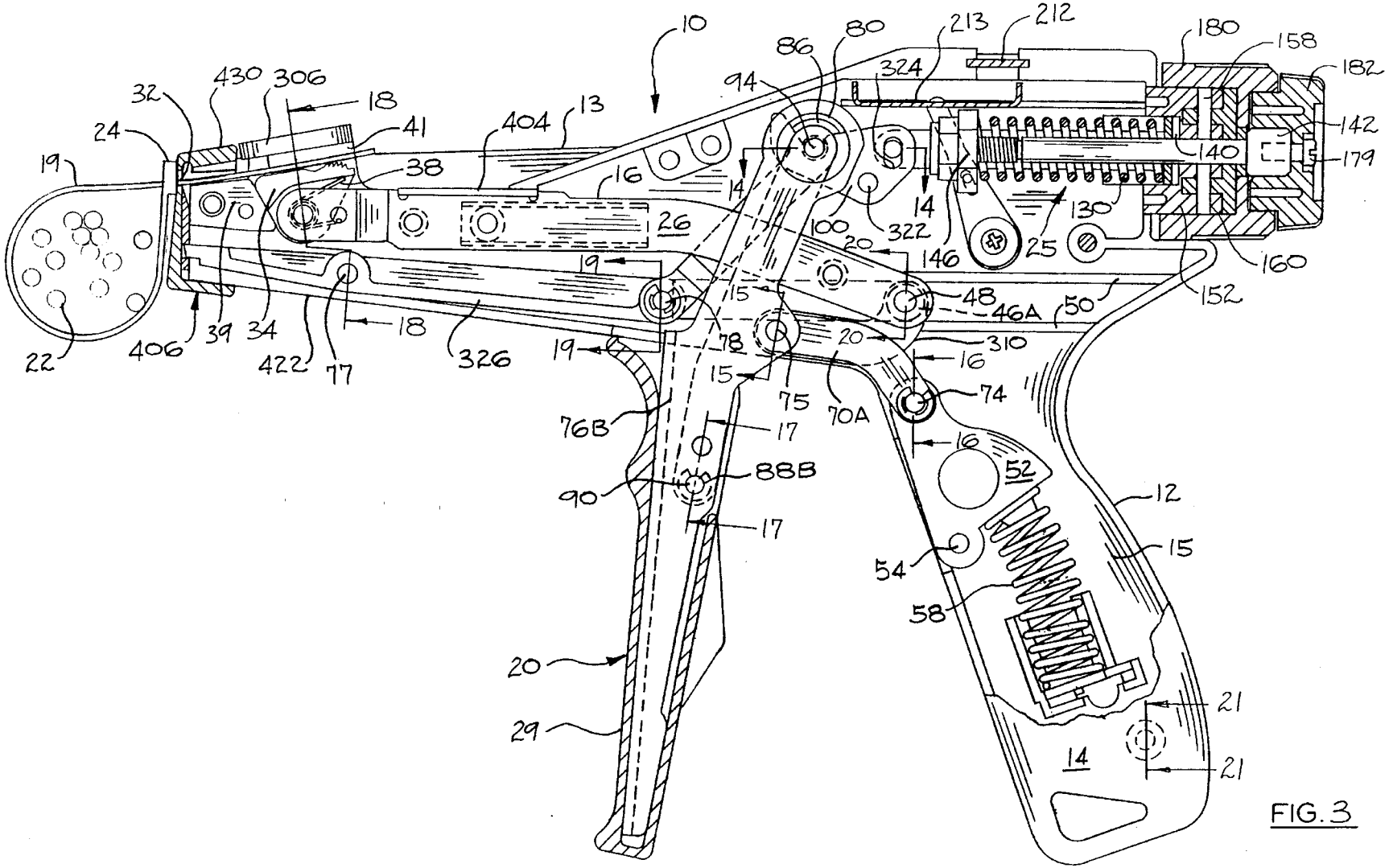
FIG. 3 is a side elevational view of the hand-held tool of FIG. 1A and having a portion broken away to show internal parts and mechanisms of the tool.
Figure 4:
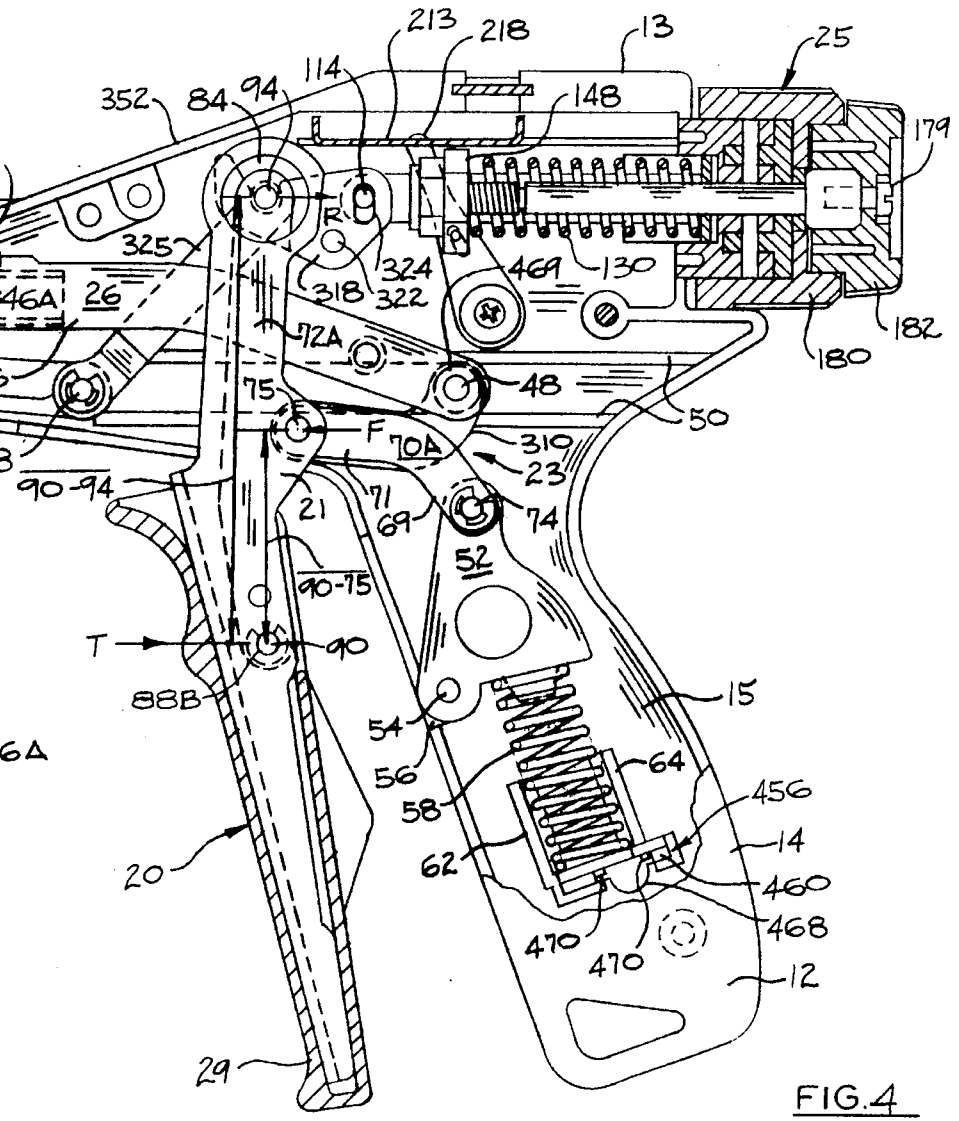
FIG. 4 is a cutaway view of the tool similar to FIG. 3 showing the tool after the trigger has been depressed and tension has been applied to the cable tie tail.

The handle link 52 is operatively connected to the trigger 20 and the actuating assembly 21 by a pair of short links 70A & 70B shown in FIGS. 3–5 as having a generally downward dogleg configuration. The short links 70A & 70B are secured at their rearward ends 69 to the handle link 52 by pivot pin 74 and at their forward ends 71 to actuating links 72A & 72B by a pivot pin 75. Pivot pin 75 forms a balance point or fulcrum for the operating forces of the tool 10. The short links 70A & 70B transmit the constant spring force of return spring 58 to the trigger 20 and actuating assembly 21.

The tool 10 is provided with a high tension link 310, shown in FIGS. 3–5 as having a generally upward dog-leg configuration. The high tension link 310 is connected at its forward end 354 to the actuating links 72A & 72B and short links 70A & 70B by the pivot pin 75, while the rear end 351 thereof is connected to the ends of the pawl links 26 by pivot pin 48. This high tension link pivot 310 transmits the tie resistance force directly to the actuating links 72A & 72B, rather than through the handle link 52. When the trigger 20 is depressed, the upper portion of the high tension link 310 slides backward in guide tracks 50, and draws the pawl links 26 rearwardly so that a tensioning force is applied to the cable tie 19.

The illustrated embodiment eliminates any direct connection between the top of the handle link 52 and the pawl links 26, and instead operatively connects the pawl links 26 to the actuating links 72A, 72B by way of the high tension link 310. The operative connection 48 between the pawl link 26 and the high tension link 310 is positioned slightly forwardly of the handle link pin connection 74, which results in a shortened stroke of the tool, that is, the rearward distance which the pawl 34 travels to sever the tie tail 18. With the high tension link 310, the opposing force generated within the handle link 52 (by both the return spring 58 and the tie tensioning force) is not transmitted to the actuating links 72A & 72B by the handle short links 70A & 70B. Rather, the tie tension force is now moved out to the end of the pawl links 26 at shaft pin 48. Thus, the tie tensioning force applied to the actuating links 72A & 72B by the high tension link 310 is reduced because the distance between the trigger actuating assembly pin connection 90 and the pawl link-high tension link connection 48 is larger than if the handle link were connected to the pawl links, resulting in a longer moment arm from pin 90, thereby reducing the force.

The pivot pin 75 connection between short links 70A, B, and the actuating links 72A, B is located between a cam follower 94 and the trigger pivot pin 90 and provides a force fulcrum for the restraining force R and the trigger force T (FIG. 4). The pivot point 75 is preferably located at approximately 40% of the distance from trigger pivot pin 90 to the cam follower 94, that is, the length of a line segment drawn between 90–75 on the actuating link is 40% of the length of a line segment drawn between 90–94. A 60:40 mechanical advantage is obtained by this relationship and a proportionally smaller tension spring 130 can be used in the tool than if the pivot point 75 were to be located at 50% (or greater) of the distance along trigger line 90–94. Consequently a tension spring 130 having a relatively smaller spring constant can be used in the tool and importantly, the force or torque required by the operator to turn the tension selection knob 180 to select a desired tension is considerably reduced.

Figure 14:
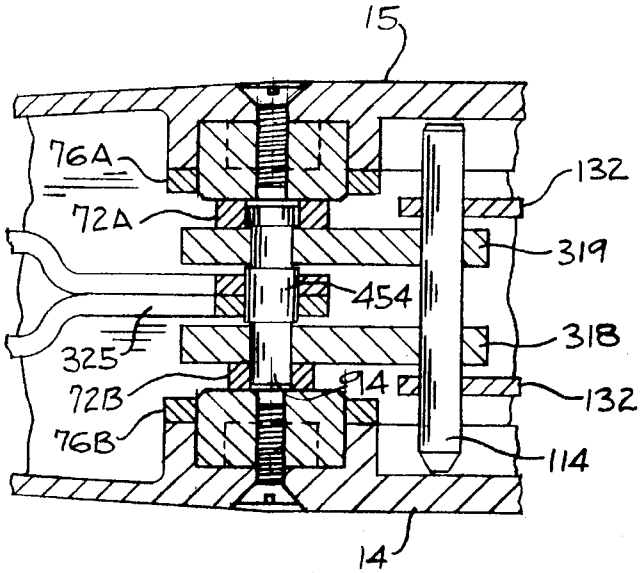
FIG. 14 s a sectional plan view taken along line 14—14 in FIG. 3.
Figure 15:
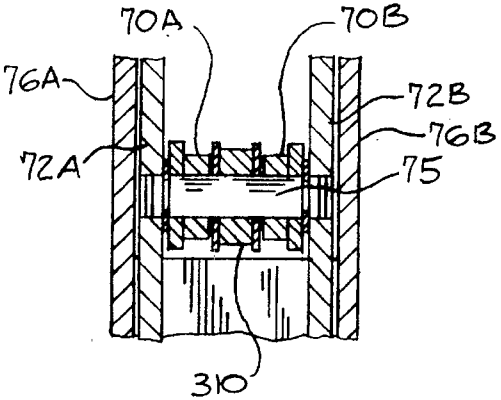
FIG. 15 s a sectional view taken along line 15—15 in FIG. 3.
Figure 16:
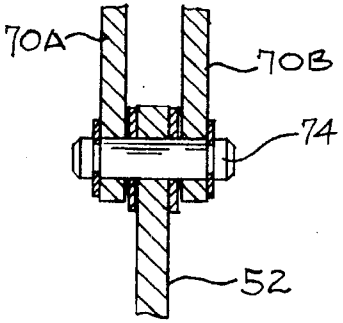
FIG. 16 s a sectional view taken along line 16—16 in FIG. 3.
Figure 18:
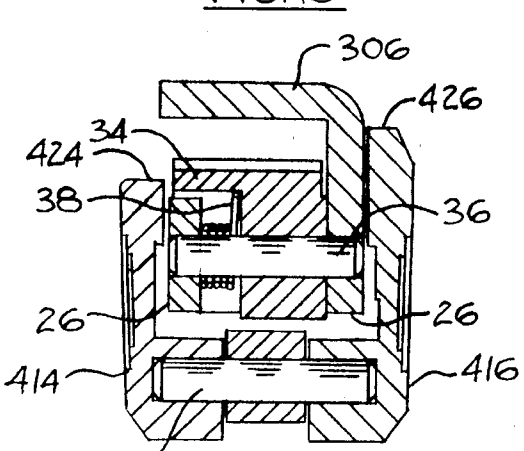
FIG. 18 is a sectional view taken along line 18—18 in FIG. 3.
Figure 17:
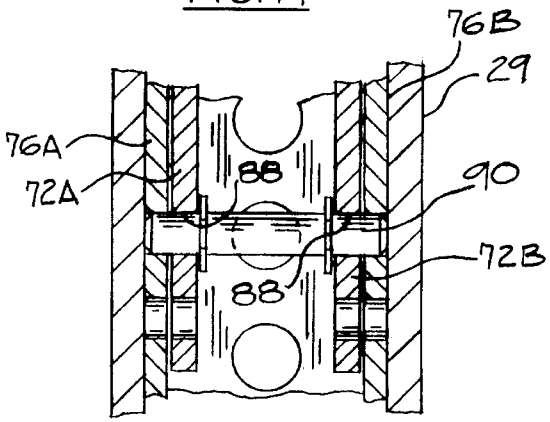
FIG. 17 s a sectional view taken along line 17—17 in FIG. 3.
Figure 19:
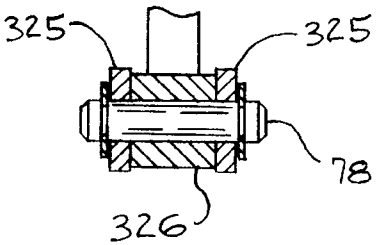
FIG. 19 is a sectional view taken along line 19—19 in FIG. 3.
Figure 21:
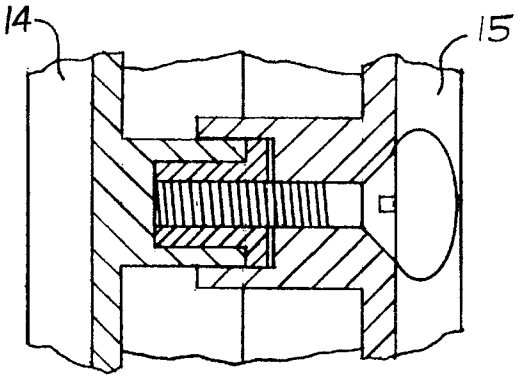
FIG. 21 is a sectional view taken along line 21—21 in FIG. 3.
Figure 20:
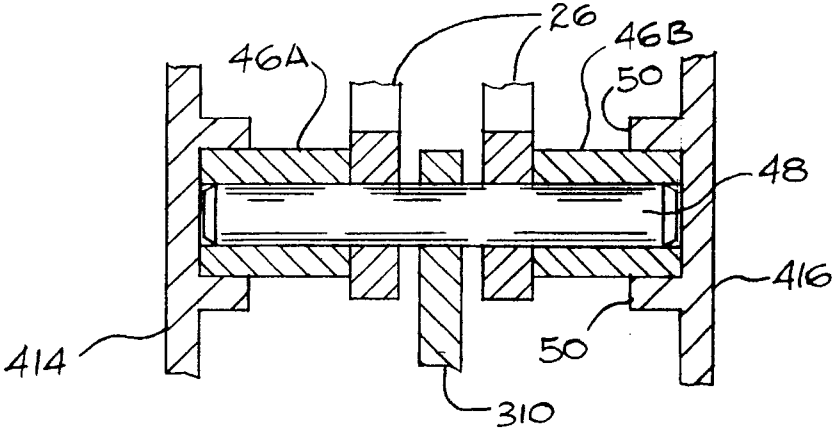
FIG. 20 is a sectional view taken along line 20—20 in FIG. 3.
Figure 23:
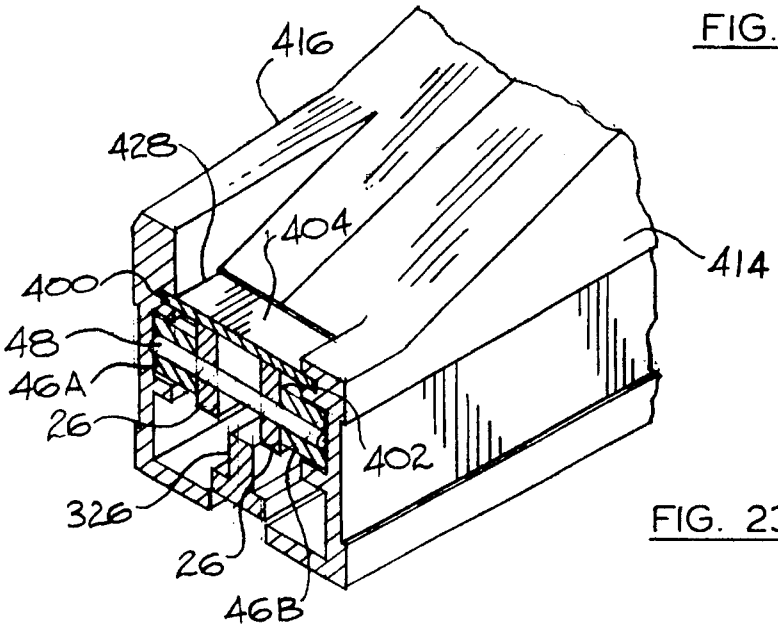
FIG. 23 is a sectional view taken along line 23—23 in FIG. 2.

Examining the trigger 20 and the actuating assembly 21 in greater detail, it can be seen that the actuating assembly comprises the pair of identical elongate actuating links 72A and 72B which are held in the trigger 20 between two elongate trigger link portions 76A and 76B which are enclosed by a flexible trigger boot 29. Trigger links 76A and 76B extend upwardly from the base of the trigger 20 into the barrel 13 where they are rotatably joined to the housing sidewalls 14 & 15 by way of trigger bearings 80. (FIG. 14) The trigger bearings 80 are held within a circular opening 82 in the top portion of each of trigger links 76A, B. The trigger bearings 80 are housed in pockets 84 formed in the tool sidewalls 14, 15. In contradistinction to previous designs, the bearings 80 are restricted against rotation relative to the pockets 84. The bearings 80 are in the general shape of a cylinder having a cylindrical head 80A, and having diametrically opposed flat surfaces 80B extending along a portion of the length of the bearing up to the head 80A. Each pocket 84 has a shape for receiving the flat surfaces 80B of the bearing 80 and thereby house the bearing 80 against rotation. Each bearing 80 is secured in its pocket 84 by a flat head screw 85. The trigger bearings 80 are manufactured of nickel steel, which is heat treated (for increased hardness), and which is then coated with zinc clear chromate.

The two actuating links 72A & 72B each have a pivot pin hole 88 (FIG. 3) formed in their lower ends to receive a trigger pivot pin 90 therein which extends between the two trigger links 76A and 76B to operatively connect the trigger 20 and the actuating assembly 21. In the illustrated embodiment, the two actuating links 72A & 72B each further have a pivot pin hole 88B (FIG. 3) formed in their lower ends above the holes 88. The pin holes 88B can be used with the pivot pin 90 if it is desired to provide a higher force type of tool.

The trigger 20 is pivotally fixed to the housing 11 by bearing hubs 86, therefore trigger pivot pin 90 always defines the same arc of rotation around the central axis of the bearing hub 86. As will be explained below, when the operator actuates the severing mechanism 28 (FIG. 5), the actuating links 72A and 72B pivot about a force fulcrum F located at pivot 75 but do not pivot around the center of the bearing hub 86.

At the top of the trigger and the actuating links 72A and 72B, the cam follower 94 is in the form of an elongate shaft held in the actuating link pivot pin holes 316 between the housing sidewalls 14, 15 in a manner which does not restrict the movement of the actuating links 72A & 72B within the tool housing. The cam follower 94 is positioned by the actuating links 72A & 72B and the cutoff cam 100 between the two opposing bearing bosses 86.

A cutoff cam 100 (FIGS. 7 and 8) provides a means for actuating the severing mechanism 28 when a preselected tension is reached in the tie tail 18. Cutoff cam 100 is preferably formed from two identical metal cam blanks 318, 319 from which two generally parallel cam arms 104A & B extend to form a cam yoke 106. The cutoff cam 100 is pivotally mounted in the barrel 13 by way of a cutoff cam pivot shaft 322 extending between the housing sidewalls 14, 15. Cam pivot shaft 322 is engaged in a pivot hole 320 formed in the lower middle portion of the cutoff cam 100 and it allow rotation or pivoting of the cutoff cam 100 and it allows rotation or pivoting of the cutoff cam 100 counterclockwise (in FIGS. 3–5) around the cam shaft 322. A cam slot 324 disposed in the rear portion 102 of the cutoff cam 100 engages a tensioning spring engagement pin 114 which operatively connects the cutoff cam 100 (and its associated actuating assembly 21) to the selective tensioning adjustment assembly 25. Cam slot 324 is elongated to allow the cam 100 to rotate around the cam pivot shaft 322 (FIG. 7).

Two distinct cam surfaces 118 and 119 are provided on each cam arm 104A & 104B. The first or rear cam surface 118 (FIG. 7) forms a generally semi-circular depression 120. The second cam surface 119 is located adjacent to and forward of first cam surface 118 and has a generally planar surface forming a cam ramp 121 which begins approximately where the curvature of the first cam surface 118 ends. A rearward restraining force R (FIG. 4) is applied to the cutoff cam 100 via spring engagement pin 114 and restrains the cutoff cam 100 from rotating around the cam pivot shaft 322 when the trigger 20 is depressed until the preselected tension is attained in tensioning a cable tie 19. During the initial depression of trigger 20, the cam follower 94 remains in the semi-circular depressions 120 of the first cam surface 118. As the trigger is further depressed, the trigger 20 continues to pivot around a fixed point at the center of the bearing hub 86. When the tension in the tie 19 approaches the preselected tension, T, the trigger force applied by the operator to the trigger 20 exceeds the tension spring restraining force, R and the top portions of the two actuating links 72A and 72B pivot counterclockwise (in FIGS. 3–5) around the force fulcrum located at pivot pin 75 and the top of actuating links 72A and 72B instantaneously advance the cam follower 94 forwardly in a linear motion out the first cam surface depression 120 along the adjacent second cam surface 119. As the cam follower 94 moves forward, the cam follower 94 rides up the second surface cam ramp 121, rotating the cutoff cam 100 counterclockwise (in FIGS. 3–5) around its pivot shaft 322. The cam follower 94 then operatively engages a cutoff link 325 held between the cam arms 104 of cam yoke 106. The cutoff link 325 is pivotally connected to a blade link 326 by a pivot pin 78. When the cam follower 94 engages cutoff link 325, it forces it downward and forward, which in turn causes rotation of a blade link 326 pivotally attached to the housing 11 by a pivot pin 77. The blade link 326 pivots clockwise (in FIGS. 3–5) and upward around pin 18, thereby bringing a tie-severing blade 128 upward into contact with the tie tail 18 and severing the tie tail 18 against the top portion 430 of the nosepiece 406 and generally adjacent the cable tie head 24. When severing the tie tail 18, the blade 128 extends out of barrel 13, past the top 412 of the barrel, through an opening defined between the nosepiece 406 and a forwardmost portion of the barrel 13 forward of the nose guide block 39, and toward the top portion 430 of the nosepiece 406.

In the illustrated embodiment, the cam follower 94 includes an enlarged diameter intermediate portion 454 captured between the cam blanks 318 and 319 so as to restrict lateral movement of the cam follower 94. In prior designs, the cam follower 94 had a uniform diameter. It has been found that by providing the enlarged diameter portion 454, and by preventing the cam follower 94 from moving laterally (in the direction along its axis), jamming, damage to the bearings 80, and unbalanced motion can be avoided. In prior designs, lateral movement of the cam follower 94 could result in frictional engagement of one of the ends of the cam follower 94 with a bearing 80, thus resulting in unbalanced motion of the cam follower 94 along the cam surfaces 118 and 119.

The top portion 430 of the nosepiece 406 includes a recess 432, facing the blade 128, into which the blade 128 travels while severing the tie tail 18. Means are provided to restrain the nosepiece 406 against flexing relative to the barrel 13 when the tie tail 18 is severed by the blade 128. The forwardmost portion of the right side 416 of the barrel further includes a notch 442, adjacent the passageway 434 and in the step 440. The notch 442 defines a surface that is parallel to the direction of travel of the blade 128 and a surface that is perpendicular to the direction of travel of the blade 128. The side portion 436 of the nosepiece 406 includes a generally triangular shaped projection 444 extending toward the passageway 434, and seated in the notch 442 to restrain the nosepiece 406 against flexing when the tie tail 18 is severed by the blade 128. Further, the nosepiece 406 includes a bottom lip portion 446 extending rearwardly from the forward surface 408, under the bottom surfaces 420 and 422, transversely to the forward surface 408, and transversely to the side portion 436. The bottom lip portion 446 extends abuts the bottom surfaces 420 and 422 and restrains the forwardmost portion of the barrel 13 against flexing when the tie tail 18 is severed by the blade 128.

The nosepiece 406 is secured to the barrel 410 by a fastening screw 448 extending through an aperture through the side portion 436 of the nosepiece and threadedly engaging a metal nut 450 seated in a circular recess 452 in the side 414 of the barrel 13. The recess 452 includes a shoulder surrounding an aperture through which the screw 448 passes, and the shoulder absorbs the tightening force when the screw 448 is tightened. This is an improvement over prior designs wherein such a screw would directly engage threading in the housing instead of engaging a nut. In the illustrated embodiment, stripping of threading in the housing is avoided, and the tightening force is distributed over a greater area.

Because the tension spring 130 constantly exerts a restraining force on the cutoff cam 100 during tensioning of the cable tie 19, and because the movement of cam follower 94 from the first cam surface 118 to the second cam surface 119 is virtually instantaneous, the tie is severed flush with the tie head while under tension, thereby ensuring that the preselected tension value is attained in the tie 19.

The present invention also provides a selective tensioning assembly 25 which enables the operator to rapidly select one of a number of preselected tension levels in the tie by rotation of tension knobs 180 or 182. As explained above, the tensioning assembly 25 applies a rearward force on the cutoff cam 100 via the tension engagement pin 114 to restrain the cutoff cam 100 from rotating forwardly around its pivot shaft 322. This restraining force is created in the tension spring 130 and transferred to the cutoff cam 100 by the engagement pin 114 held within the rear wall 102 of cutoff cam 100.

Figure 8:
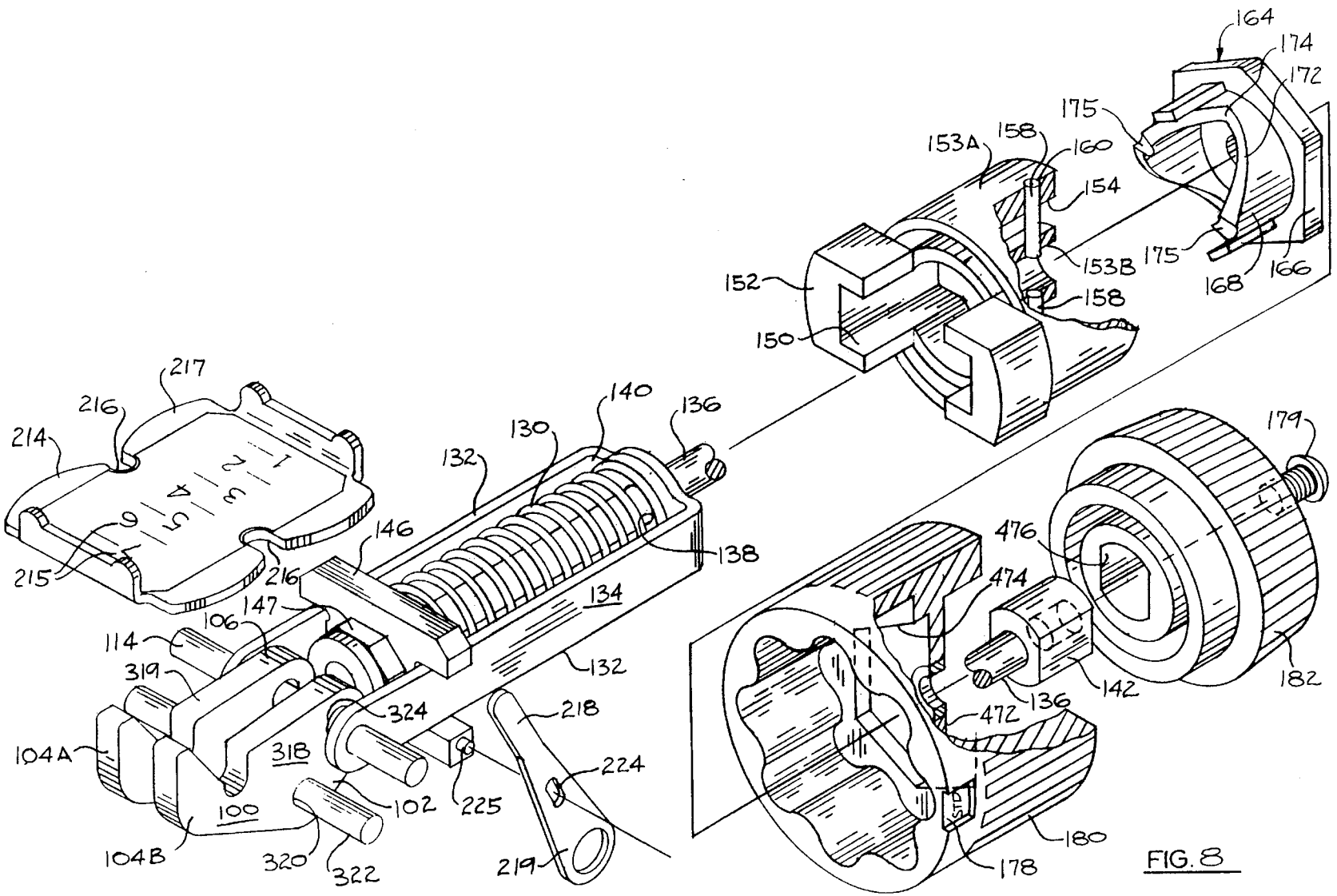
FIG. 8 is a perspective view, partially broken away, of the tie tensioning mechanism used in the tool shown in FIG. 1A.

FIG. 8 shows a preferred embodiment of a selective tensioning assembly 25 which comprises a tension spring 130 held between two arms 132 of a U-bracket 134. The spring 130 encircles a tension shaft 136 axially disposed within the bracket arms 132. A tension engagement pin 114 joins the bracket arms 132 together at the front of the bracket 134, while the rear of the bracket includes an endplate 140 which has a generally cylindrical opening 138 to accommodate the passage therethrough of the tension shaft 136. The rear end of tension shaft 136 includes an enlarged key portion 142 which abuttingly engages the back surface 472 of the knob 180. Tension shaft 136 has a threaded portion 145 at its front end which threadedly engages a threaded tension nut 146. The tension nut 146 has opposite slots which ride along the bracket arms 132 and which prevent rotation of the tension nut 146 relative to the bracket arms 132. In the initial tool position (FIG. 3) the tension spring 130 is subjected to a slight preload or compression due to its placement between the tension nut 146 and the bracket endplate 140 (compressed approximately 0.060 inches from its free length). It will be seen that any rearward movement of the tension nut 146 on tension shaft 136 will increase the compression on spring 130, and increase the rearward or restraining force that the spring 130 exerts upon the cutoff cam 100.

As best seen in FIG. 8, bracket 134 fits in a recess 150 of a fixed cam 152, this cam being fixed to the tool barrel 13 at the rear of tool housing 11. Fixed cam 152 includes two axially spaced and generally cylindrical walls 153A & 153B which define therebetween an annular slot 154 which accommodates a cylindrical extension 168 of an axial cam 164. Two crosspieces 158 extend radially through the fixed cam outer wall **153*a* and are held in a fixed relationship to each other approximately 180° apart in two radial openings 160. These crosspieces 158 protrude into the slot 154 in the fixed cam 152, and define a fixed point of engagement on the tool 11 for distinct cam surfaces 174 & 175 on the axial cam 164**. These distinct cam surfaces will be discussed below in more detail.

Figure 13:
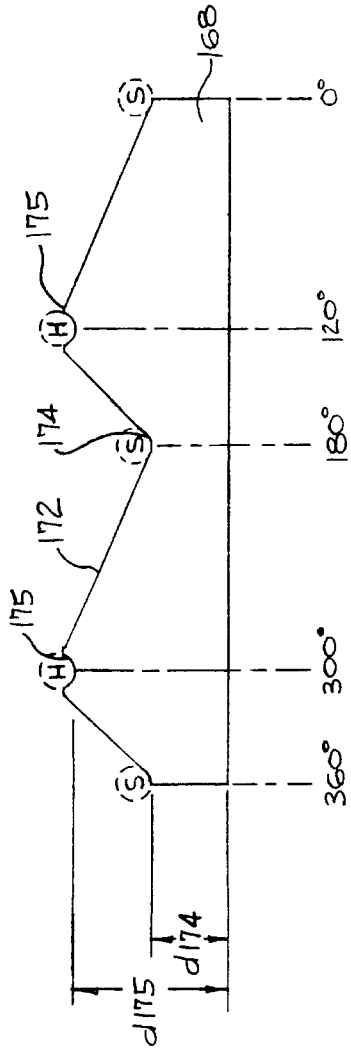
FIG. 13 is a diagram showing the profile of the cam surfaces of the axial cam of FIG. 11.
Figure 11:
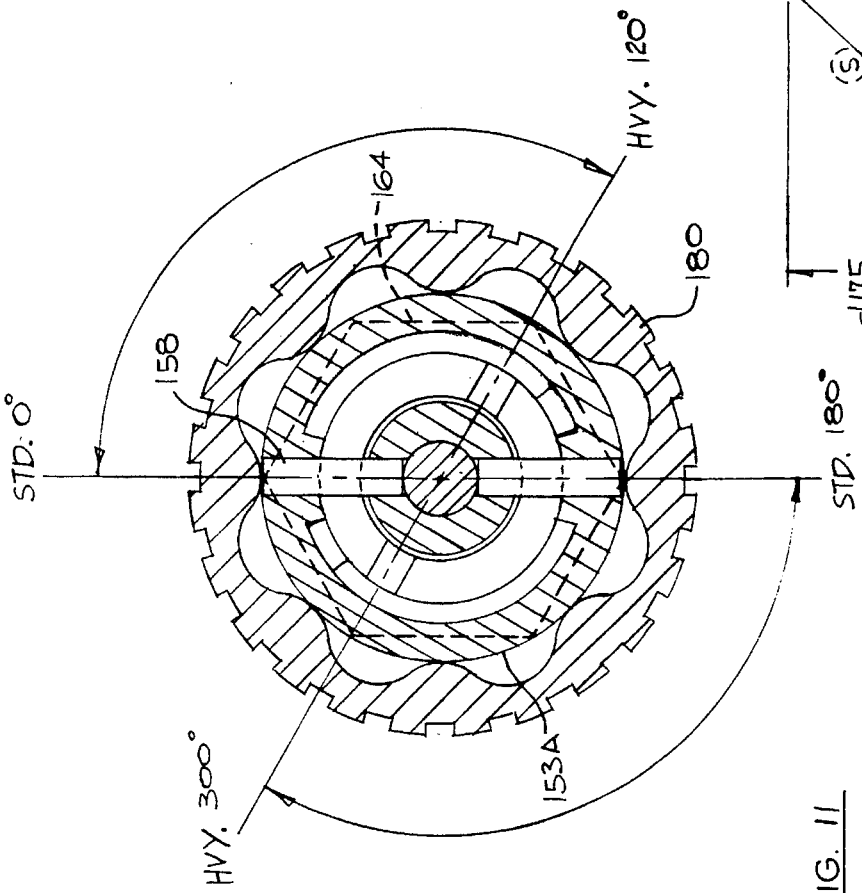
FIG. 11 is a sectional view taken along line 11—11 in FIG. 9.

The axial cam 164 has a base 166 which preferably has a non-circular configuration, (shown in FIG. 8 as a hexagon) so that it engagingly fits within a complimentary shaped recess 474 centered in the tension or cam knob 180 and provides a means of operative engagement between them such that the axial cam 164 rotates with tension knob 180 when the latter is turned by the tool operator. The cylindrical cam extension 168 extends axially outwardly from the cam base 166, and the axial face of this extension 168 provides a generally circular cam surface 172. This axial cam surface 172 is further divided into pairs of cam surfaces, (FIGS. 8 & 11–13) as distinct pairs 174 & 175 each pair having a different length of axial extent from the cam base 166, represented in FIG. 13 as $d_{174}$ & $d_{175}$. The cam surface pairs 174 and 175 are defined by semi-circular depressions on the cam surface 172, which depressions engage the complimentary cylindrical configuration of the fixed cross pieces 158 and are spaced apart from one another.

Compression of the tension spring is selectively increased by the operator rotating the tension knob 180 which also rotates the axial cam 164. In the standard setting, cam surface pair 174 engages the crosspieces 158 to establish a preselected compression or preload of tension spring 130. When the first pair of axial cam surfaces 174 engage the crosspieces 158, the distance between the tension nut rear face 148, and the bracket endplate 140 is substantially at a maximum and thus the compression exerted on tension spring 130 is at a minimum setting. Because the knob 180 engages the enlarged portion 142 of tension shaft 136, when the knob 180 is turned from the standard position to the heavy position the tension nut 146 is drawn rearwardly toward the bracket endplate 140 (which is fixed in its location in the fixed cam recess 150), a distance corresponding to the height of the cam surfaces 175 relative to the cam surfaces 174. Turning the tension knob 180 to the heavy tension setting brings the other cam surface pair 175 into engagement on the fixed crosspieces 158, which increases the compression on spring 130 (and decreases the distance between the tension nut 146 and bracket endplate 140) by an amount equal to the extent of the axial cam pair 175 relative to the axial cam pair 174. Increasing the compression in the tension spring 130 in this manner increases the restraining force applied to the cutoff cam 100 via engagement pin 114. Due to the 60:40 mechanical advantage described above, the tension spring force R is smaller and the torque required by the operator to rotate tension knob 180 (and hence increase the compression on tension spring 130) is reduced, thereby reducing operator fatigue. Visual indicators 178 may be affixed to the outer circumference of tension knob 180 to indicate to the operator which preselected tension value is chosen.

A second tension adjustment knob 182 is provided so that the operator has a means for finely adjusting or "fine-tuning" the tension values chosen by rotation of tension knob 180. The knob 182 includes a recess 476 having a shape corresponding to the shape of the enlarged portion 142 of the tension shaft 136. The enlarged portion 142 of the tension shaft 136 is seated in the recess 476. Knob 182 is fixedly attached to the tension shaft 136 by means of a screw 179 which connects the fine adjustment knob 182 to shaft 136 (FIGS. 3–5) in the enlarged diameter shaft portion 142 so that the shaft 136 and knob 182 are co-rotatable. Thus, rotation of the tension shaft 136 moves the threaded tension nut 146 a slight distance forward or backward on the threaded shaft portion 145, depending on the direction of rotation of knob 182. Shaft 136 extends axially through a common circular and coaxial opening in tension knob 180, axial cam 164 and the fixed cam 152 so that when shaft 136 is rotated by turning the fine adjustment knob 182, the shaft 136 does not rotatably engage either the tension knob 180 or the axial cam 164. The front shaft portion 145 is threaded for a distance limited by a stop 147. The stop 147 limits the extent of travel of the tension nut 146 on the front shaft portion 145, and correspondingly limits the amount of fine adjustment in the compression of spring 130. By turning the fine adjustment knob 182, the operator can slightly increase or decrease the spring length between the tension nut 146 and the rear of U-bracket 112.

Figure 9:
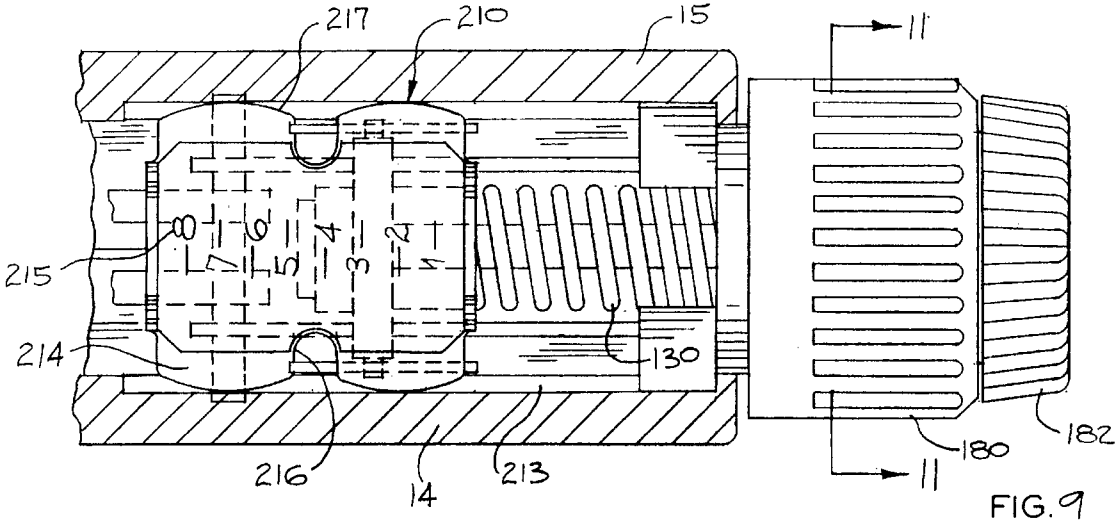
FIG. 9 is a plan view, partially broken away, of a fine tensioning adjustment mechanism and tension indicator used in the tool shown in FIG. 1A.
Figure 10:
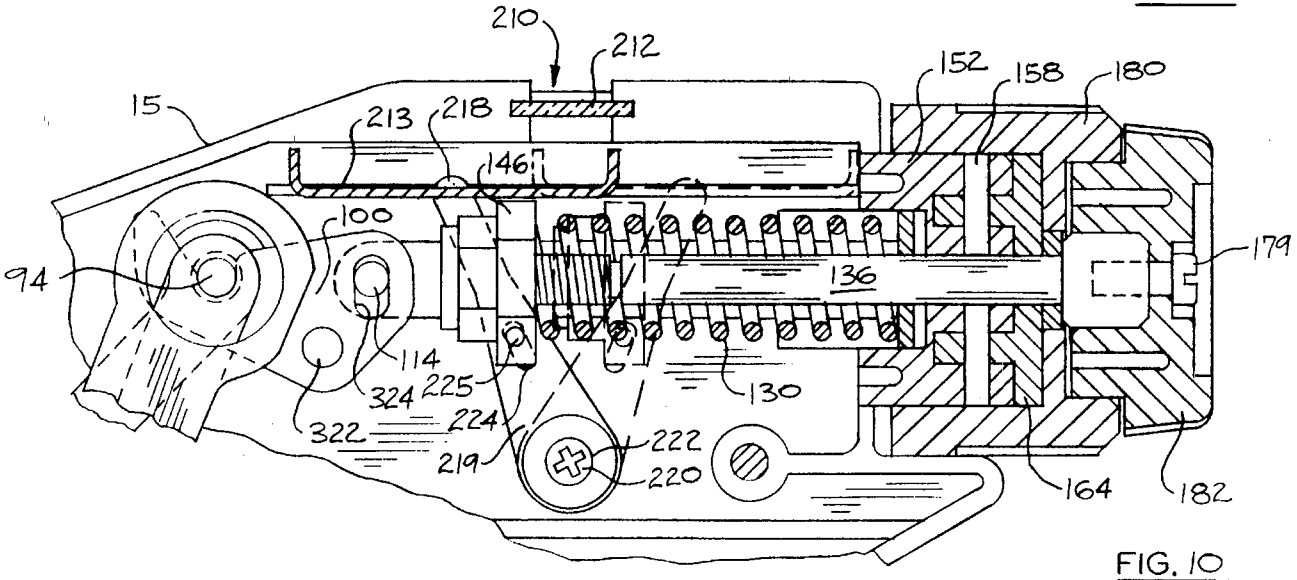
FIG. 10 is a fragmentary elevational view of the tool shown in FIG. 1A showing a fine tensioning adjustment mechanism.
Figure 12:
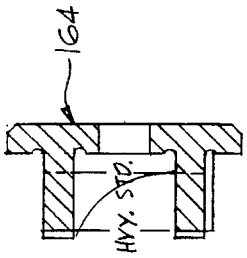
FIG. 12 is a sectional view of an axial cam shown in FIG. 11.

A means for visually indicating the adjustment level setting is shown generally as 210 in FIGS. 9– 10. A window 212 is provided in the top of the tool housing 11 over the tensioning assembly 25. Guide tracks 213 are formed in the housing sidewalls 14 & 15 and support a display plate 214 which is slidable on the tracks 213. The display plate 214 has a plurality of tension value indicating digits 215 thereon arranged in two vertical rows generally parallel to the longitudinal axis of the tool in which the individual digits in one row are vertically offset from the individual digits in the other row so that only one digit may fully appear through the window 212 at any one time. Each indicating digit 215 on the display plate 214 is approximately the same size as the housing window 212 so that the operator can dial one digit corresponding to a preselected tension value into view beneath window 212. Sliding display plate 215 is generally flat and has means for engaging the tensioning assembly 25 in the form of parallel notches 216 in the length 217 of display plate 214. These notches 216 engage fingers 218 of either one or a pair of indicator levers 219, which are attached to the housing sidewalls 14 & 15 by pivotal means shown in the Figures as a housing boss 220 engaged by a circular opening 222 at the lower end of indicator lever(s) 219.

Where only one lever arm 219 is used, it can be located on either the right hand side of the tensioning assembly as illustrated in FIGS. 3–5 & 10, or on the left hand side thereof as shown in FIG. 8. In the illustrated embodiment of the invention, a pair of parallel spaced apart lever arms 219 are employed. At approximately the middle of the lever arm 219, an elongated slot 224 is provided to engage a pin 225 on the tension nut 146 which extends outwardly therefrom generally transverse to the tension shaft 136 and below the tensioning assembly U-bracket arms 132. It will be appreciated that by virtue of this connection, any movement of the tension nut 146 on the tension shaft 136 will move the indicator lever(s) 219 parallel to the tension shaft to correspondingly slide the display plate 214 beneath the window 212, as shown in phantom in FIG. 10 to bring a different tension value indicating digit 215 into view in the window 212 to thereby indicate the tension value setting of the tool.

For example, when the tension knob 180 is rotated to set the axial cam 164 to its standard position (where cam surface pair 174 engage the crosspieces 158), the digits "2" and "3" will substantially appear in the indicator window 212 (depending on the setting of the knob 182) so as to indicate a setting of 2.5. Turning the tension knob 180 to the heavy position (where cam surface 175 engages the crosspieces) will cause the digit "6" to substantially appear in the window. Turning the fine adjustment tension knob 182 in either direction so that the tension nut 146 advances its maximum distance either forward or backward on the shaft 136 will cause the digits numerically adjoining the digit obtained from the tension knob 180 to sequentially substantially appear in the window 212. In the case of the standard and heavy tension settings mentioned above, the digits "1" through "4", and "5" through "8" respectively will appear in the window 212, depending on the amount and direction of rotation of knob 182. The maximum stroke of the display plate 214 (that is the travel distance between digits "1" and "8" appearing in display window 212) is approximately 0.630 inches. To effect this stroke the tension nut 146 travels a distance of approximately 0.296 inches on the tension shaft 136. A 2:1 movement multiplier for the tool is thereby attained, which allows the size of indicating digits 215 to be increased for greater visibility to the tool operator.

In an alternative embodiment of the invention (not shown) only one knob is employed to adjust tension, such as in the manner illustrated in FIG. 7 of U.S. Pat. No. 4,997,011.

The tool 10 further includes a spare blade compartment 456 in the handle 12, for storing a replacement blade (not shown). The replacement blade is substantially identical to blade 128, and can be used to replace blade 128 when blade 128 wears out. More particularly, the compartment 456 is defined by a slot 460 in the handle 12. The compartment 456 further includes one or more protrusions 470, integral with the handle 12, extending downwardly into the slot 460 to retain the replacement blade in the slot 460 by friction. The compartment 456 further includes a slit shaped opening 462 (FIG. 1) in one of the sidewalls 14 and 15, which opening 462 is aligned with the slot 460 and is sufficiently wide and high to permit insertion and removal of the replacement blade into and out of the compartment 456. The compartment 456 further includes an opening 464 in the other of the sidewalls 14 and 15, which opening 464 includes a rectangular portion 466 aligned with the slot 460 but not as wide as the slot 460 so as to prevent passage of the replacement blade through the opening 464. The opening 464 further includes a half circle shaped portion 468 extending from the rectangular portion 466. To remove the replacement blade from the compartment 456, a user can insert a screwdriver into the opening 464 to push the blade 458 out of the opening 462.

In operation, a cable tie tail 18 is inserted into the nose slot 32 with the tool at its normal, initial position (FIG. 3) with the tie head 24 positioned adjacent the nose slot 32. The three angled surfaces 304, 305 and 308 cooperate to orient the tie tail 18 upwardly. As the trigger 20 is depressed by the operator toward the handle 12 the trigger links 76A & 76B and the actuating links 72A & 72B rotate around the center of the bearing hubs 86, while the cam follower 94 slightly rotates in the first cam surface depression 120. The pawl links 26 are drawn rearwardly, sliding in the guide tracks 50 and causing the handle link 52 and the two short links 70A & 70B to pivot about their respective pivot pins. As the tension on the pawl links 26 increases due to the closing of the cable tie loop around the bundle of wires 34, a force equal to the tension in the tie (the tie input force, F) is translated through the high tension link 310 to the pivot point 75 of the actuating links 72A & 72B which serves as the fulcrum for operation of the cutoff cam 100 by the actuating links 72A & 72B. Two rearward forces act to oppose this tie input force. One force, T, is created by the operator depressing the trigger 20 and is transmitted from the trigger 20 to the actuating link trigger pivot pin 90. The second force is the restraining force, R, supplied by the tension spring 130 which applies a rearward force on the cutoff cam 100 through the axial cam 164, the fixed cam 152 and the U-bracket 134. A balance is established when the total rearward forces T and R equal the forward force F. At this equilibrium point the severing mode of the tool begins (FIG. 5)

The severing mode begins when the operator-applied trigger force exceeds the restraining force supplied by the tension spring and presented through the 60:40 mechanical advantage found on the actuating links 72A & 72B. At this instant, the pair of actuating links 72A & 72B act as if they are a single beam supported on a fulcrum (pivot point 90) with the restraining force R pulling one end of it rearward at cam follower 94 and the trigger force T pulling the other end rearward at trigger pivot pin 90. As the trigger force T exceeds the tension spring restraining force R, the pair of actuating links 72A & 72B (the beam) will pivot counterclockwise (in FIGS. 3–5) around its pivot point 90 and the top of those links will move forwardly while the trigger 20 maintains its fixed pivotal axis around the center of the bearing hub 86. The cam follower 94 is urged out of the first cam surface depression 120 by the pivoting of actuating links 72A & 72B to the cam ramp 121 of the second cam surface 119 and moves linearly thereon (FIG. 7). The movement of cam follower 94 causes the cutoff link 325 to move forwardly and downwardly, thereby causing the blade link 326 to rotate around pivot pin 77 to move the blade 128 upward to sever the tie tail 18. After severing the tie tail 18, the operator releases the pressure on the trigger 20 and the handle return spring 58 forces the paul links 26 forwardly to the nose guide block 39, so that the pawl front face 301 engages and moves along the nose block depression 300, thereby opening the tie passageway 41 of the pawl links 26 and allowing the severed tie tail to fall to waste. Due to this unique mechanical linkage arrangement, the tool gives reliable and consistent tensioning of ties with tension values between 9 and 55 pounds and clean, flush severing results.

While the preferred embodiments of the invention have been shown and described, it will be obvious to those skilled in the art that changes and modifications may be made therein without departing from the spirit of the invention, the scope of which is defined by the appended claims.

We claim:

1. A tool for tensioning and severing an elongate cable tie having a tie head portion and tie tail portion, said tool comprising:

a housing having opposed slots, means, supported by said housing, for gripping and tensioning the tail of the cable tie, said means including pawl links, and a tie guide plate integral with one of said pawl links, located outside of said housing, and having a tie tail engaging surface, said gripping and tensioning means being capable of reciprocating linear movement relative to said housing, and said gripping and tensioning means including a rotatable pawl adapted to selectively engage the cable tie tail and apply pressure to said cable tie tail so that it is pressed against said tie tail engaging surface of said guide plate during linear movement of said gripping and tensioning means, a pawl cover mounted on said pawl links, having opposite edges mounted in said slots in said housing for sliding reciprocal movement with said pawl links, said pawl cover in said slots restraining said pawl links and said tie guide plate against twisting about an axis parallel to the direction of linear reciprocal movement, said pawl cover further impeding entry of said tie tail into said housing, means for severing the cable tie tail from the cable tie head upon attainment of a preselected tension in the cable tie, actuating means for actuating said tensioning means and being capable of pivotal and linear movement, said actuating means being operatively connected to said severing means and said gripping and tensioning means, and restraining means for restraining said actuating means to pivotal movement until a preselected tension is achieved in the cable tie by said gripping and tensioning means, whereupon said actuating means moves linearly to actuate said severing means to sever the cable tie tail from the cable tie head.

2. A tool as set forth in claim 1 and further including means for positioning said tie tail away from said pawl cover, said positioning means comprising said tie tail engaging surface of said guide plate being angled relative to said pawl cover such that when said rotatable pawl applies pressure to the cable tie tail so that it is pressed against said tie guide plate, a portion of the tie tail adjacent said pawl cover is angled away from said pawl cover.

3. A tool as set forth in claim 2 wherein said tie tail engaging surface is angled between 2° and 12° relative to said pawl cover.

4. A tool as set forth in claim 1 wherein said pawl cover comprises a synthetic thermoplastic or thermosetting material, and wherein said housing comprises synthetic thermoplastic or thermosetting material, so that there is plastic to plastic contact between said pawl cover and said slots.

5. A tool as set forth in claim 4 wherein said pawl cover consists essentially of grey nylatron, and wherein said housing consists essentially of glass filled nylon.

6. A tool as set forth in claim 1 wherein said housing has thereon guide means, separate from said slots, for guiding said gripping and tensioning means in said reciprocating linear movement, wherein said tool further comprises a linkage operatively connecting said tensioning means with said actuating means, and wherein said gripping and tensioning means further includes roller bearing means slideably engaging said guide means.

7. A tool as set forth in claim 1 wherein said housing is in the general shape of a gun, and includes a handle portion, and a barrel portion forward of said handle portion, said barrel portion having a top and a bottom, wherein said severing means includes a blade selectively movable in said barrel portion along the direction defined between said bottom and top of said barrel portion, said tool further comprising a nosepiece mounted to said barrel portion, said nosepiece including a top portion spaced from said top of said barrel portion, said blade severing the cable tie tail against said top portion of said nosepiece when said actuating means actuates said severing means, said nosepiece further including a forward surface integral with and transverse to said nosepiece top portion, said forward surface being generally parallel to said blade, said nosepiece further including a bottom lip portion integral with and transverse to said forward surface, said bottom lip portion extending along said bottom of said barrel portion, in contact with said bottom of said barrel portion.

8. A tool as set forth in claim 7 wherein said nosepiece is manufactured by investment casting.

9. A tool as set forth in claim 7 wherein said barrel further includes opposite sides, wherein said nosepiece further includes a side portion integral with and transverse to said forward surface, transverse to said nosepiece bottom lip portion, transverse to said nosepiece top portion, and extending along one of said barrel sides, the other of said barrel sides including a recess having therein an aperture and a shoulder surrounding said aperture, said tool further comprising a screw fastening said nosepiece to said barrel, said screw extending through said nosepiece side portion and into said aperture in said recess, and said tool further comprising a nut in said recess, engaging said shoulder, and threaded to said screw.

10. A tool as set forth in claim 1 wherein said actuating means includes an actuator, cam means, and a cam follower operatively connecting said cam means to both said actuator and said severing means, wherein said cam means has a pair of spaced apart cam arms, said cam arms having parallel spaced apart first and second cam surfaces, said first cam surfaces being arcuate and providing for pivotal movement of said cam follower thereon, and said second cam surfaces being generally planar, being adjacent said first cam surfaces, and providing for linear movement of said cam follower thereon, wherein said cam follower is restrained to pivotal movement on said first cam surfaces by said restraining means until the preselected tension is attained in the cable tie whereupon said actuator moves said cam follower from said first cam surfaces to said second cam surfaces and into operative engagement with said severing means to actuate said severing means, and wherein said tool further comprises means on said cam follower and cooperating with said cam arms for restricting movement of said cam follower in the direction defined between said cam arms.

11. A tool as set forth in claim 10 wherein said means for restricting movement of said cam follower comprises a projection on said cam follower, which projection is captured between said cam arms.

12. A tool as set forth in claim 10 wherein said means for restricting movement of said cam follower comprises said cam follower having an enlarged diameter portion which is captured between said cam arms.

13. A tool as set forth in claim 1 wherein said housing has opposite sides, and wherein a spare blade compartment is defined in said housing, said spare blade compartment including a slot selectively housing a spare blade, a first opening on one of said sides of said handle permitting insertion and removal of the spare blade from said handle, a second opening on the other side of said handle which will not permit passage of the spare blade but which can be accessed by a tool to push the spare blade out of the handle, said spare blade compartment further including resilient means extending into said slot for releasably retaining the spare blade in said slot by friction.

14. A tool as set forth in claim 1 wherein said housing includes a handle portion having opposite sides, wherein a spare blade compartment is defined in said handle portion, said spare blade compartment comprising a slot selectively housing a spare blade, a first opening on one of said sides of said handle permitting insertion and removal of the spare blade from said handle, a second opening on the other side of said handle, in the shape of a rectangle having a half circle extending from a side of the rectangle, which second opening will not permit pass the spare blade but which can be accessed by a tool to push the spare blade out of the handle, said spare blade compartment further including resilient means extending into said slot for releasably retaining the spare blade in said slot by friction.

15. A tool for tensioning and severing an elongate cable tie having a tie head portion and tie tail portion, said tool comprising:

a housing in the shape of a gun, said housing being in the general shape of a gun and including a handle portion and a barrel portion forward of said handle portion, said barrel portion having a top and a bottom, means, supported by said housing, for gripping and tensioning the tail of the cable tie, said means including pawl links, and a tie guide plate integral with one of said pawl links, located outside of said housing, and having a tie tail engaging surface, said gripping and tensioning means being capable of reciprocating linear movement relative to said housing, and said gripping and tensioning means including a rotatable pawl adapted to selectively engage the cable tie tail and apply pressure to said cable tie tail so that it is pressed against said tie tail engaging surface of said guide plate during linear movement of said gripping and tensioning means, means for severing the cable tie tail from the cable tie head upon attainment of a preselected tension in the cable tie, said severing means including a blade selectively movable in said barrel portion along the direction defined between said bottom and top of said barrel portion, actuating means for actuating said tensioning means and being capable of pivotal and linear movement, said actuating means being operatively connected to said severing means and said gripping and tensioning means, restraining means for restraining said actuating means to pivotal movement until a preselected tension is achieved in the cable tie by said gripping and tensioning means, whereupon said actuating means moves linearly to actuate said severing means to sever the cable tie tail from the cable tie head, and a nosepiece mounted to said barrel portion, said nosepiece including a top portion spaced from said top of said barrel portion, said blade severing the cable tie tail against said top portion of said nosepiece when said actuating means actuates said severing means, said nosepiece further including a forward surface integral with and transverse to said nosepiece top portion, said forward surface being generally parallel to said blade, said nosepiece further including a bottom lip portion integral with and transverse to said forward surface, said bottom lip portion extending along said bottom of said barrel portion, in contact with said bottom of said barrel portion.

16. A tool for tensioning and severing an elongate cable tie having a tie head portion and tie tail portion, said tool comprising:

a housing having opposite sides, means, supported by said housing, for gripping and tensioning the tail of the cable tie, said means including pawl links, and a tie guide plate integral with one of said pawl links, located outside of said housing, and having a tie tail engaging surface, said gripping and tensioning means being capable of reciprocating linear movement relative to said housing, and said gripping and tensioning means including a rotatable pawl adapted to selectively engage the cable tie tail and apply pressure to said cable tie tail so that it is pressed against said tie tail engaging surface of said guide plate during linear movement of said gripping and tensioning means, means for severing the cable tie tail from the cable tie head upon attainment of a preselected tension in the cable tie, actuating means for actuating said tensioning means and being capable of pivotal and linear movement, said actuating means being operatively connected to said severing means and said gripping and tensioning means, restraining means for restraining said actuating means to pivotal movement until a preselected tension is achieved in the cable tie by said gripping and tensioning means, whereupon said actuating means moves linearly to actuate said severing means to sever the cable tie tail from the cable tie head, and a spare blade compartment defined by said housing, said spare blade compartment including a slot selectively housing a spare blade, a first opening on one of said sides of said handle permitting insertion and removal of the spare blade from said handle, a second opening on the other side of said handle which will not permit passage of the spare blade but which can be accessed by a tool to push the spare blade out of the handle through said first opening, said spare blade compartment further including resilient means extending into said slot for releasably retaining the spare blade in said slot by friction.

* * * * *

UNITED STATES PATENT AND TRADEMARK OFFICE

CERTIFICATE OF CORRECTION

PATENT NO. : 5,492,156

DATED : February 20, 1996

INVENTOR(S) : Edward P. Dyer, et al.

It is certified that error appears in the above—identified patent and that said Letters Patent is hereby corrected as shown below:

Column 17, lines 27-28 should read --extending from a side of the rectangle, which second opening will not permit passage of said spare blade but which can be--.

Signed and Sealed this

Third Day of September, 1996

*Attest:*

Bruce Lehman

BRUCE LEHMAN

*Attesting Officer*

*Commissioner of Patents and Trademarks*